US008567288B1

(12) United States Patent
Minnie

(10) Patent No.: US 8,567,288 B1
(45) Date of Patent: Oct. 29, 2013

(54) BELT WRENCH FOR CAM GEAR AND METHOD OF USE THEREOF

(76) Inventor: Sean D. Minnie, Signal Hill, CA (US)

( * ) Notice: Subject to any disclaimer, the term of this patent is extended or adjusted under 35 U.S.C. 154(b) by 211 days.

(21) Appl. No.: 12/898,934

(22) Filed: Oct. 6, 2010

(51) Int. Cl.
*B25B 13/52* (2006.01)
*B25B 27/00* (2006.01)

(52) U.S. Cl.
USPC ..... 81/64

(58) Field of Classification Search
USPC ..... 81/64, 3.43; D8/14, 22
See application file for complete search history.

(56) References Cited

U.S. PATENT DOCUMENTS

| | | | | | |
|---|---|---|---|---|---|
| 1,383,123 | A | * | 6/1921 | Jones | 81/64 |
| 2,128,991 | A | * | 9/1938 | Eighmey | 73/862.26 |
| 2,181,012 | A | * | 11/1939 | Bunting | 81/64 |
| 2,422,715 | A | * | 6/1947 | Blake | 81/3.4 |
| 2,481,055 | A | * | 9/1949 | Whitaker | 81/3.43 |
| 2,656,749 | A | * | 10/1953 | Johnson | 81/64 |
| 3,505,914 | A | * | 4/1970 | Ockinga | 81/65.2 |
| 3,752,016 | A | | 8/1973 | Ballard | |
| 3,962,936 | A | | 6/1976 | Lewis | |
| D242,981 | S | | 1/1977 | Craig | |
| 4,145,938 | A | | 3/1979 | Laird, Jr. | |
| D307,101 | S | * | 4/1990 | Anderson | D8/22 |
| 4,987,804 | A | * | 1/1991 | Greenawalt | 81/64 |
| D314,894 | S | * | 2/1991 | Jacobs | D8/14 |
| 5,390,570 | A | * | 2/1995 | Reisner | 81/64 |
| D369,076 | S | | 4/1996 | Alexander | |
| 6,035,745 | A | | 3/2000 | Kather | |
| 6,089,126 | A | | 7/2000 | Teeter et al. | |
| 6,948,404 | B1 | * | 9/2005 | Chokshi | 81/3.43 |
| 6,978,703 | B2 | | 12/2005 | Whitehead et al. | |
| 6,988,430 | B1 | | 1/2006 | Putney et al. | |
| 7,040,198 | B2 | | 5/2006 | Gelpi, Jr. | |
| D527,962 | S | * | 9/2006 | Kang | D8/22 |
| 7,810,219 | B2 | * | 10/2010 | Lindemann | 24/31 R |
| 2003/0177873 | A1 | * | 9/2003 | Johnson | 81/64 |
| 2003/0177874 | A1 | * | 9/2003 | Sipos et al. | 81/64 |
| 2005/0204870 | A1 | * | 9/2005 | Fa | 81/64 |
| 2008/0047398 | A1 | * | 2/2008 | Buchanan | 81/65.4 |
| 2008/0060171 | A1 | * | 3/2008 | Lindemann | 24/31 R |
| 2011/0167964 | A1 | * | 7/2011 | Price | 81/64 |

* cited by examiner

*Primary Examiner* — David B Thomas
(74) *Attorney, Agent, or Firm* — Montgomery Patent & Design; Robert C. Montgomery

(57) ABSTRACT

A belt wrench for a cam gear comprising a linear timing belt section wherein a first end is formed into a closed loop configuration. Whereas primarily intended for automotive use, the belt wrench is equally useful in the installation or removal of the gears of any timing belt mechanism. The looped end is designed to be installed onto a fixed gear location while the linear portion of the belt wrench immobilizes the appropriate gear by being partially wrapped around.

12 Claims, 5 Drawing Sheets

BELT WRENCH FOR CAM GEAR AND METHOD OF USE THEREOF

RELATED APPLICATIONS

The present invention was first described in a notarized Official Record of Invention on Sep. 3, 2009, that is on file at the offices of Montgomery Patent and Design, LLC, the entire disclosures of which are incorporated herein by reference.

FIELD OF THE INVENTION

The present invention relates generally to torque applying hand tools, and in particular, to a belt wrench particularly adapted for secure retention of motor engine gears during repair processes.

BACKGROUND OF THE INVENTION

Engine maintenance is a particularly critical aspect of the upkeep of motor vehicles. In particular, internal combustion engine components such as cam gears requires precise tightening and alignment in order to ensure proper, efficient, safe operation of the vehicle.

While it is extremely critical for internal combustion engines that parts are well tightened and accurately placed, it is also important that no marks or imperfections are left behind. This requirement usually eliminates the practice of holding items with pliers or wrenches while bolts are tightened or loosened. As such, items like cam gears remain extremely difficult to remove and replace. Proper alignment is often relegated to a trial and error process because of slippage between the gear and nut during tightening. This results in increased time and decreased accuracy for the proper alignment of gears.

Various attempts have been made to provide device which provide counterbalancing torque to a generally round assembly for various applications. Examples of these attempts can be seen by reference to several U.S. patents. U.S. Pat. No. 3,752,016, issued in the name of Ballard, describes a combination wrench which provides a retention means to a round assembly such as a pipe to prevent lateral and rotational movement while working on the assembly.

U.S. Pat. No. 3,962,936, issued in the name of Lewis, describes a strap wrench with an adjustable wrenching loop for engaging a round object.

U.S. Pat. No. 6,089,126, issued in the name of Teeter et al., describes a size-adjustable belt wrench with an adjustable clasping portion.

Additionally, ornamental designs for a strap wrench exist, particularly U.S. Pat. Nos. D 242,981 and D 369,076. However, none of these designs are similar to the present invention.

While these devices fulfill their respective, particular objectives, each of these references suffer from one (1) or more of the aforementioned disadvantages. Many such devices are not sufficiently adjustable. Also, many such devices engage objects in a manner which is potentially damaging to an uneven surface. Furthermore, many such devices sufficiently decrease in effectiveness when not utilized on smooth round surfaces. In addition, many such devices are not adapted for use on many common mechanical assemblies such as those found in motor vehicles. Accordingly, there exists a need for a belt wrench without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide secure counterbalancing torque to gear assemblies in a manner which is manageable by a single user and which does not damage the assembly. Thus, the object of the present invention is to solve the aforementioned disadvantages and provide for this need.

To achieve the above objectives, it is an object of the present invention to provide a secure gripping means for cam gear timing belt components while loosening or tightening an axial fastener. The device comprises a belt section, a loop, and a loop fastener.

Another object of the present invention is to provide secure and non-damaging gripping of gear profiles via a similarly profiled interior surface of the belt section.

Yet still another object of the present invention is to provide a means for a single user to supply counterbalancing torque during a fastener tightening process. A user may place the loop about an existing gear, tighten the loop fastener, and apply a torque to a desired gear in a desired orientation by pulling on a distal end of the belt portion.

Yet still another object of the present invention is to alternately comprise the loop fastener of a permanent integral junction between an outer end of the loop and a face portion of the belt section, providing a secure and pre-sized engaging means for an existing portion of an engine.

Yet still another object of the present invention is to alternately comprise the loop fastener of an adjustable loop which provides a continuous selectable size adjustment function to the loop.

Yet still another object of the present invention is to provide a method for constructing the device from used, readily available motor vehicle components.

Yet still another object of the present invention is to provide a method of utilizing the device that provides a unique means of procuring or assembling an instance of the device, installing the device about a cam gear assembly, providing securement of the loop about a stationary portion of the assembly, tightening the loop via adjustable of the loop fastener if desired, and providing directional counterbalancing torque to maintain the relative position of a gear during an axial fastener tightening process.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
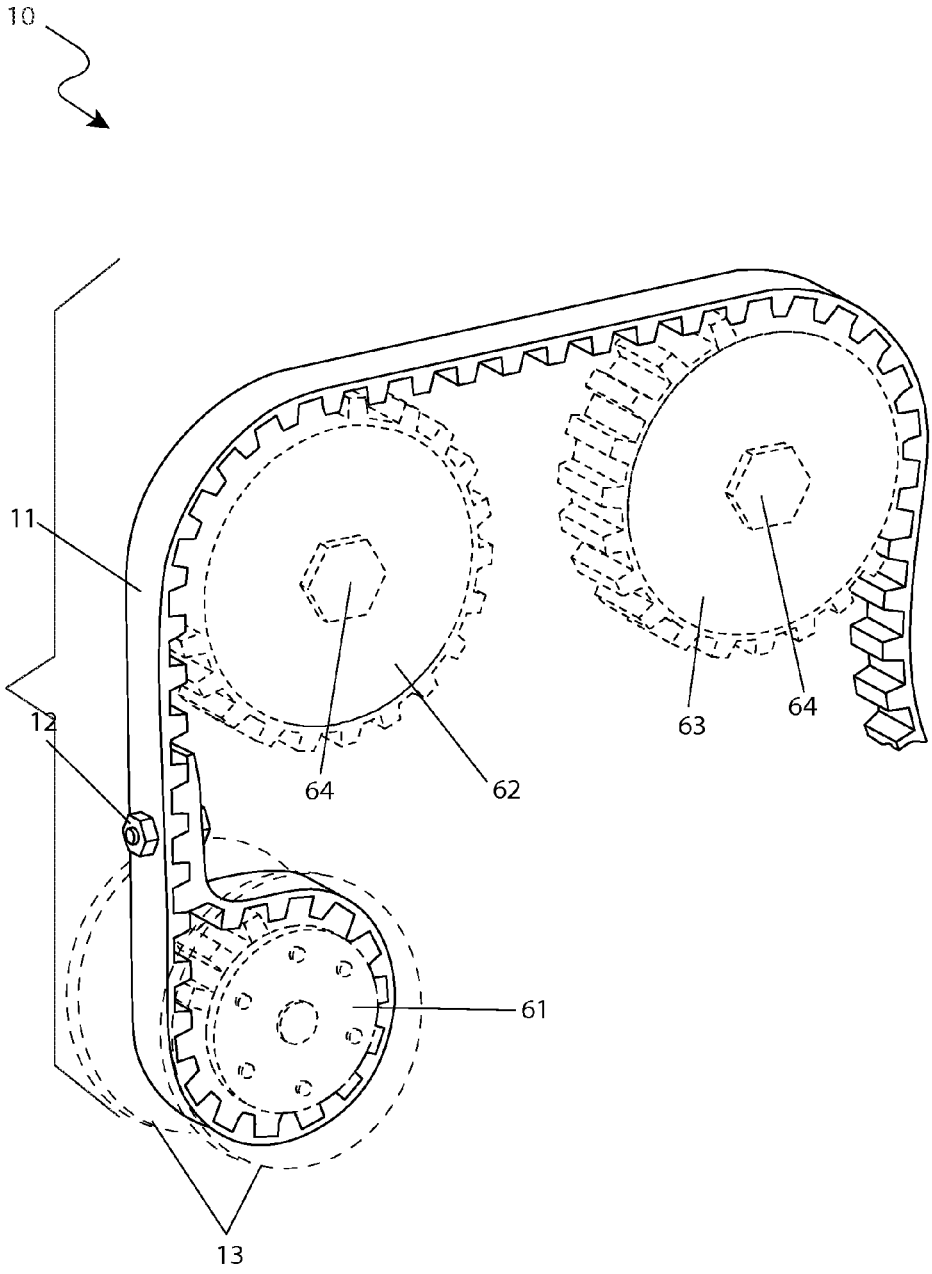
FIG. 1 is an environmental perspective view of a cam gear cam gear timing belt wrench 10, according to a preferred embodiment of the present invention.

10 cam gear timing belt wrench
11 linear timing belt section
12 loop fastener
13 loop
20 first alternate cam gear timing belt wrench
21 first alternate linear belt section
22 integral junction
23 first alternate loop
30 second alternate cam gear timing belt wrench
31 second alternate linear belt section
32 loop ring
33 adjustable loop
34 ring eye
61 flanged gear
62 first gear
63 second gear
64 axial fastener
66 third gear

DETAILED DESCRIPTION OF THE PREFERRED EMBODIMENT

Figure 2A:
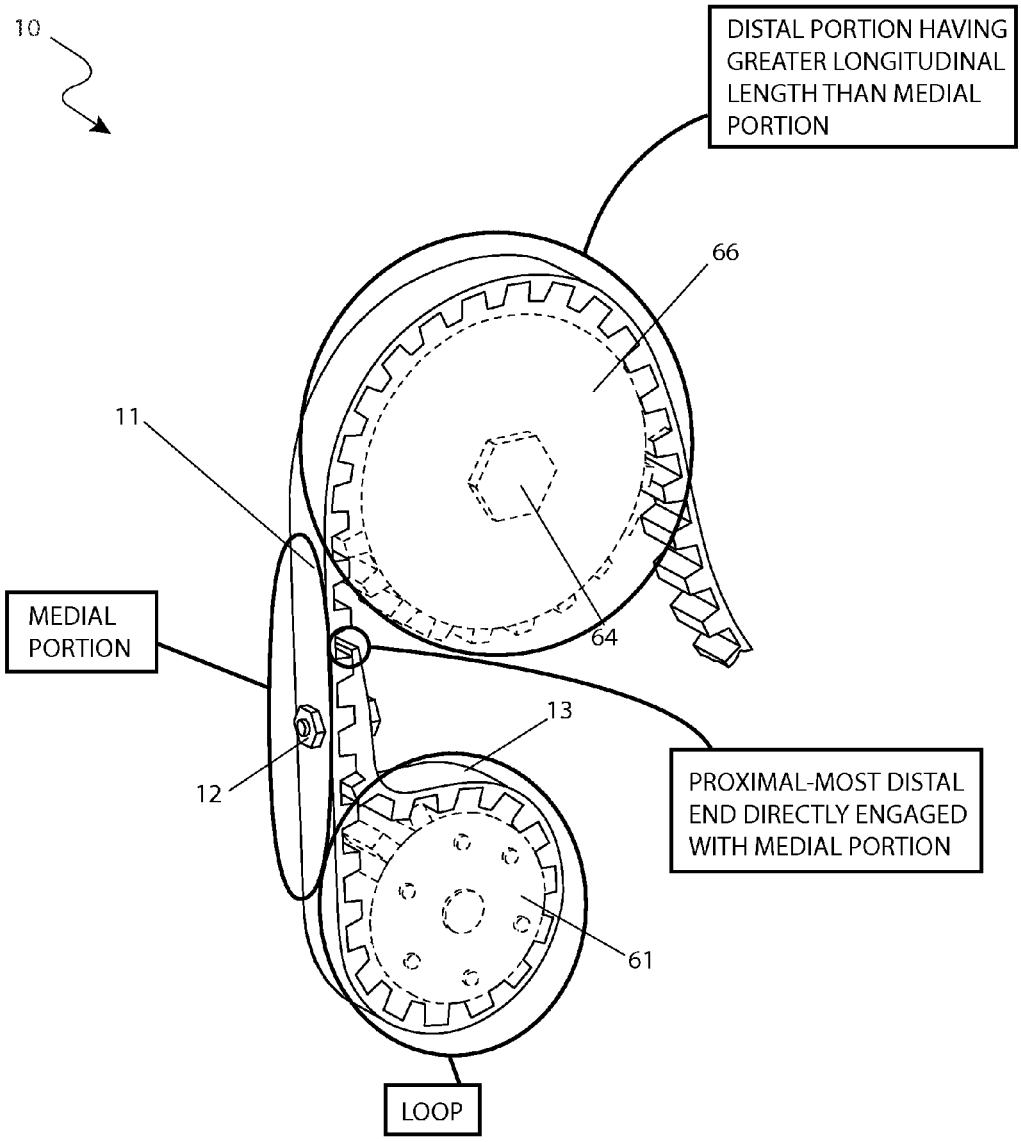
FIG. 2A is a right-hand environmental perspective view of the cam gear cam gear timing belt wrench 10, according to the preferred embodiment of the present invention.
Figure 2B:
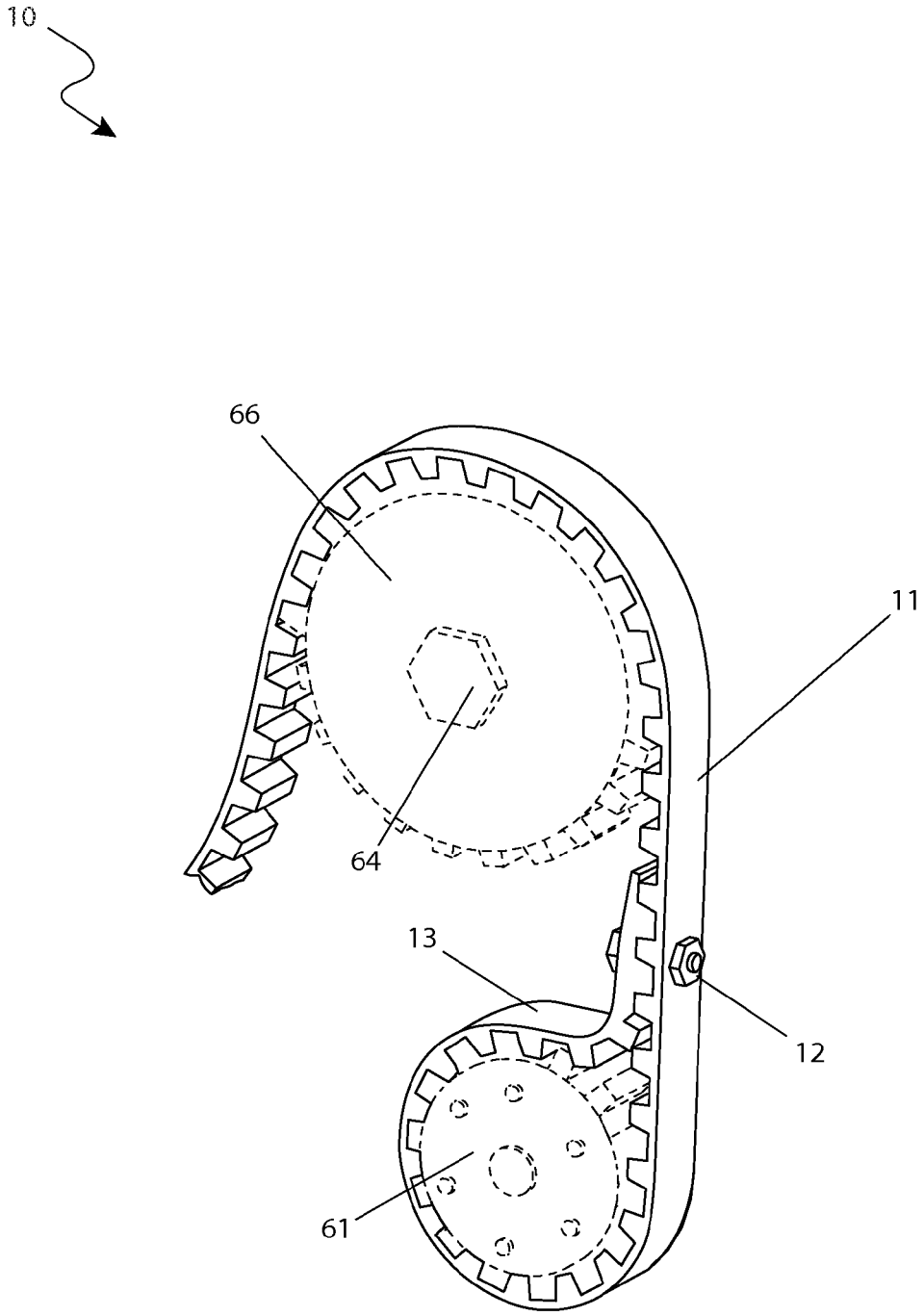
FIG. 2B is a left-hand environmental perspective view of the cam gear timing belt wrench 10, according to the preferred embodiment of the present invention.
Figure 3A:
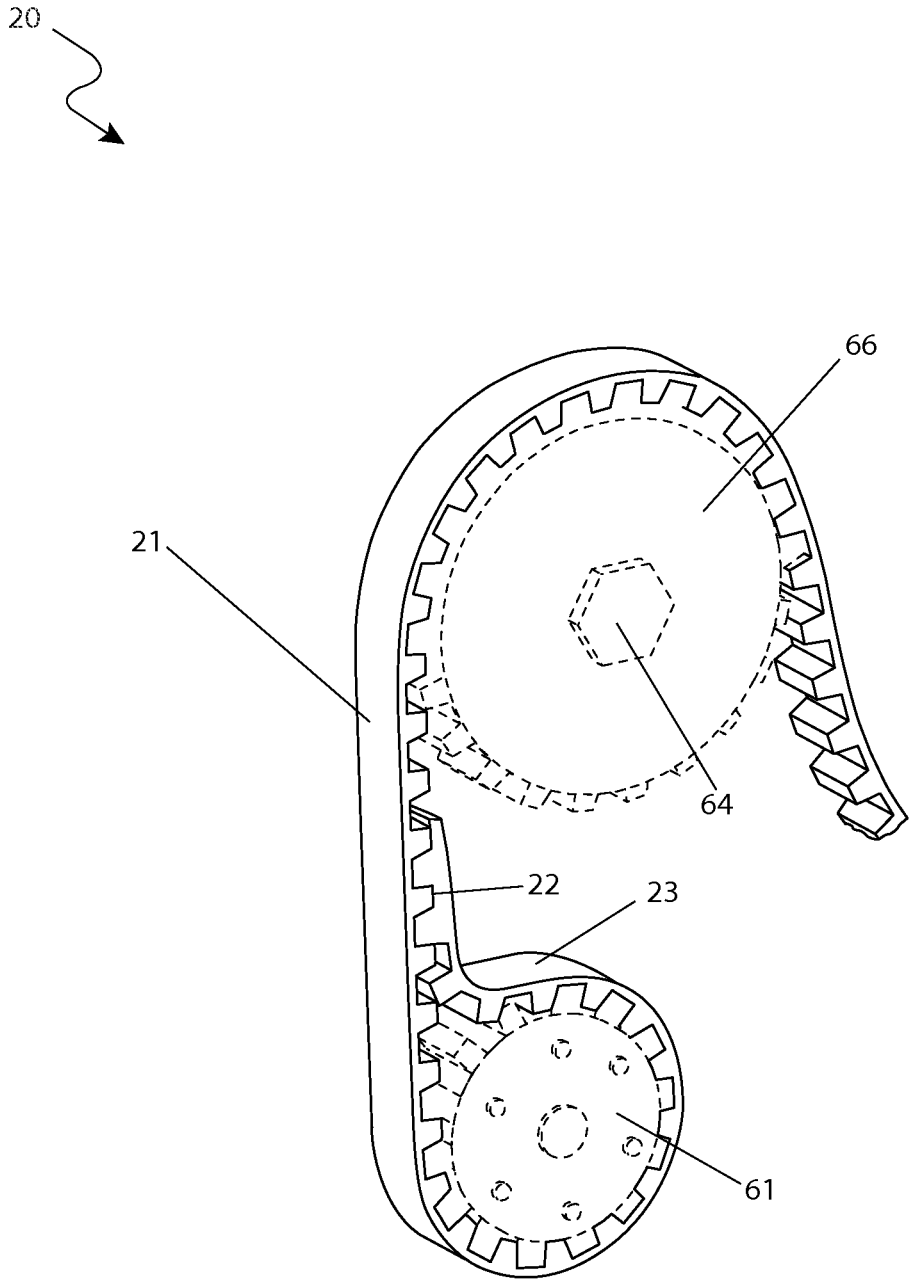
FIG. 3A is an environmental perspective view of a first alternate cam gear timing belt wrench 20, according to an alternate embodiment of the present invention; and, FIG. 3B is an environmental perspective view of a second alternate cam gear timing belt wrench 30, according to another alternate embodiment of the present invention.
Figure 3B:
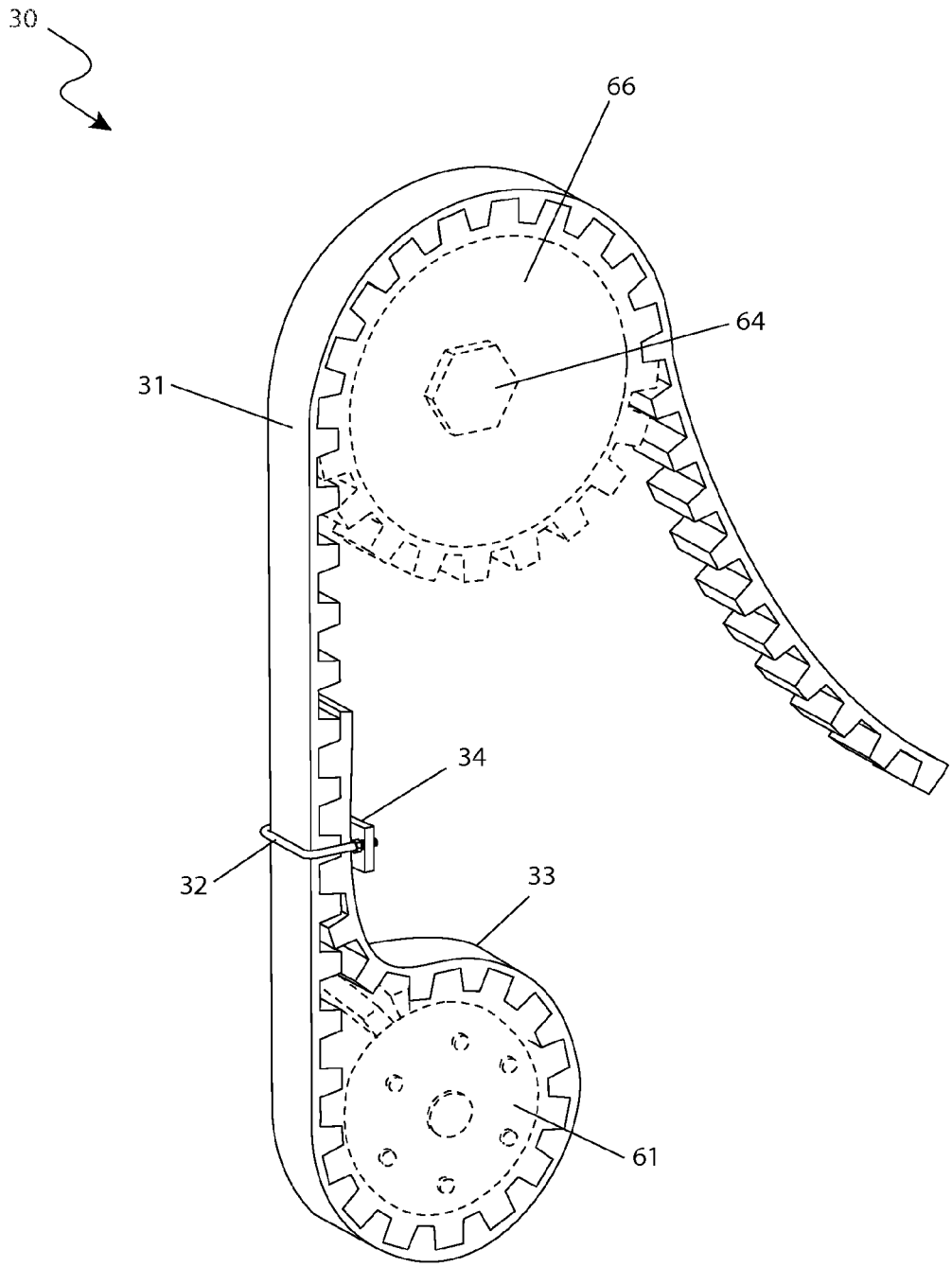

The best mode for carrying out the invention is presented in terms of its preferred embodiment, herein depicted within FIGS. 1 through 3A, and in terms of alternate embodiments, herein depicted within FIGS. 3A and 3B. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a cam gear timing belt wrench device a (herein described as the "device") 10, which provides a safe and damage-free means for gripping and immobilizing timing belt gears 62, 63, 66 while loosening or tightening an axial fastener 64.

Referring now to FIG. 1, an environmental perspective view of the device 10, according to the preferred embodiment of the present invention, is disclosed. The device 10 comprises a linear timing belt section 11, a loop fastener 12, and a loop 13, is depicted in a state of gripping twin timing belt gears comprising a first gear 62 and a second gear 63, while the loop 13 is encircling a flanged gear 61.

Whereas the timing belt configuration depicted within FIG. 1 is similar to that of a twin overhead camshaft internal combustion engine, it is envisioned that the device 10 or similar devices can be useful in gripping and thereby immobilizing timing gears 62, 63 or 65 of any other timing belt drive configuration, thereby allowing a loosening or tightening of their axial fasteners 64.

Referring now to FIG. 2A, a right-hand environmental perspective view of the device 10, according to the preferred embodiment of the present invention, is disclosed. The device 10 comprises the loop 13 in the state of encircling the flanged gear 61. The depicted right-hand installation of the device 10 immobilizes a third gear 65 in clockwise direction, thereby allowing the axial fastener 64 to be rotated thereinto the clockwise direction, wherein the torque-induced load is transmitted thereonto the tangential portion of the linear belt section 12. The load resisting fixed point is provided by the loop 13 while encircling the flanged gear 61.

Referring now to FIG. 2B, a left-hand environmental perspective view of the device 10, according to the preferred embodiment of the present invention, is disclosed. The depicted left-hand installation of the device 10 immobilizes the third gear 65 in a counterclockwise direction, thereby allowing the axial fastener 64 to be rotated into the counterclockwise direction, wherein the torque-induced loads are transmitted in a manner similar to the right-configuration.

The timing belt configuration depicted within FIGS. 2A and 2B is similar to that of a single overhead cam lay-out of an internal combustion engine. A similar right-hand or left-hand installation of the device 10 applies to the drive configuration depicted within FIG. 1

It is envisioned that the preferred embodiment of the device 10 comprising the loop 13 and the depicted loop fastener 12 would be a home made tool.

Referring now to FIG. 3A, an environmental perspective view of a first alternate cam gear timing belt wrench 20, according to a first alternate embodiment of the present invention, is disclosed. The first alternate cam gear timing belt wrench 20, envisioned to be a manufactured tool, comprises a permanent integral junction 22 between an outer end of the loop 23 and a cleated face portion of the first alternate linear belt section 21. The integral junction 22 is envisioned to be achieved by means such as molding or chemical bonding.

Referring now to FIG. 3B, an environmental perspective view of a second alternate cam gear timing belt wrench 30, according to a second alternate embodiment of the present invention, is disclosed. The first alternate cam gear timing belt wrench 30, envisioned to be a manufactured tool comprising and adjustable loop 33, wherein the adjustment is achieved by a loop ring 32 pivotally fastened into an integral ring eye 34. The loop ring 32 loosely encircles the second alternate linear belt section 31 and is allowed to move freely in an axial direction along the belt section 31.

It is envisioned that other styles and configurations of the present invention can be easily incorporated into the teachings of the present invention, and only one particular configuration shall be shown and described for purposes of clarity and disclosure and not by way of limitation of scope. Other styles would include linear belt sections 11, 21, 31 comprising various pitches and loop sizes to accommodate various timing drive designs.

The method of utilizing the device 10 may be achieved by performing the following steps: procuring a used timing belt; cutting the belt to achieve a linear belt section 11; forming one end of the linear belt section 11 into a loop 13 of a desired diameter; securing the loop 13 configuration; drilling an aperture for the loop fastener 12; inserting and tightening the loop fastener 13; installing the device as indicated in FIG. 1, 2A or 2B to accommodate the prevailing drive configuration and rotational direction of the axial fastener 64; grasping and firmly holding the loose end of the linear belt section 11 while loosening the desired axial fastener 64; removing and replacing the desired gear 62, 63, 65; reversing the installation of the device 10 to allow tightening the axial fastener 64.

The alternate embodiments 20 or 30 of the present invention can be utilized by the common user in a simple and effortless manner with little or no training. After initial purchase or acquisition of the alternate device 20 or the alternate device 30, each would be installed as indicated in FIG. 1, 3A or 3B and following the utilization steps similar to those described for the preferred embodiment.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A timing belt wrench for gripping and immobilizing at least one timing gear of a timing belt drive and thereby permitting a user to loosen and tighten an axial fastener of the at least one timing gear, said timing belt wrench comprising:

a linear timing belt section having a plurality of cleats adapted to grip the at least one timing gear of the timing belt drive, said linear timing belt section having a loop adapted to encircle a flanged portion of at least one gear;

wherein said linear timing belt section has a proximal-most end extending away from said loop and further has a medial portion extending away from said loop, said proximal-most end being directly engaged with said medial portion to form said loop; and, wherein said linear timing belt section further has a distal portion integrally formed with said medial portion, said distal portion having a longitudinal length greater than a longitudinal length of said loop such that said distal portion is capable of gripping the at least one timing gear of the timing belt drive while said loop is capable of gripping said flanged portion of an adjacent timing gear.

2. The timing belt wrench of claim 1, further comprising: a loop fastener attached to said loop and said linear timing belt section.

3. The timing belt wrench of claim 1, wherein said timing belt wrench comprises: a permanent integral junction situated between an outer end of said loop and a cleated face portion of said linear timing belt section.

4. The timing belt wrench of claim 1, wherein said timing belt wrench comprises:

an integral ring eye formed at said loop; and a loop ring pivotally fastened onto said integral ring eye and encircled about said linear timing belt section;

wherein said loop ring enables said loop to be adjusted;

wherein said loop ring is freely movable in an axial direction along said linear timing belt section.

5. A method of utilizing a timing belt wrench for gripping and immobilizing at least one timing gear of a timing belt drive and thereby permitting a user to loosen and tighten an axial fastener of the at least one timing gear, said method comprising the steps of:

providing a linear timing belt section having a plurality of cleats;

said cleats gripping the at least one timing gear of the timing belt drive;

said linear timing belt section having a loop encircling a flanged portion of at least one gear;

immobilizing another gear of the timing belt drive in a clockwise direction;

transmitting a torque-induced load onto a tangential portion of said linear timing belt section; and said loop resisting the torque-induced load at a fixed point and thereby causing clockwise rotation of the axial fastener;

wherein said linear timing belt section has a proximal-most end extending away from said loop and further has a medial portion extending away from said loop, said proximal-most end being directly engaged with said medial portion to form said loop; and, wherein said linear timing belt section further has a distal portion integrally formed with said medial portion, said distal portion having a longitudinal length greater than a longitudinal length of said loop such that said distal portion is capable of gripping the at least one timing gear of the timing belt drive while said loop is capable of gripping said flanged portion of an adjacent timing gear.

6. The timing belt wrench of claim 5, further comprising: a loop fastener attached to said loop and said linear timing belt section.

7. The timing belt wrench of claim 5, wherein said timing belt wrench comprises: a permanent integral junction situated between an outer end of said loop and a cleated face portion of said linear timing belt section.

8. The timing belt wrench of claim 5, wherein said timing belt wrench comprises:

an integral ring eye formed at said loop; and a loop ring pivotally fastened onto said integral ring eye and encircled about said linear timing belt section;

wherein said loop ring enables said loop to be adjusted;

wherein said loop ring is freely movable in an axial direction along said linear timing belt section.

9. A method of utilizing a timing belt wrench for gripping and immobilizing at least one timing gear of a timing belt drive and thereby permitting a user to loosen and tighten an axial fastener of the at least one timing gear, said method comprising the steps of:

providing a linear timing belt section having a plurality of cleats by procuring a timing belt, and cutting said timing belt to achieve said linear belt section;

said cleats gripping the at least one timing gear of the timing belt drive;

forming and securing one end of said linear timing belt section into a loop;

installing said timing belt wrench on said timing belt drive by encircling said loop about a flanged portion of at least one gear;

grasping and firmly holding a loose end of said linear timing belt section while loosening the axial fastener;

removing and replacing a desired timing gear of the timing belt drive; and tightening the axial fastener;

wherein said linear timing belt section has a proximal-most end extending away from said loop and further has a medial portion extending away from said loop, said proximal-most end being directly engaged with said medial portion to form said loop; and, wherein said linear timing belt section further has a distal portion integrally formed with said medial portion, said distal portion having a longitudinal length greater than a longitudinal length of said loop such that said distal portion is capable of gripping the at least one timing gear of the timing belt drive while said loop is capable of gripping said flanged portion of an adjacent timing gear.

10. The timing belt wrench of claim 9, further comprising: a loop fastener attached to said loop and said linear timing belt section.

11. The timing belt wrench of claim 9, wherein said timing belt wrench comprises: a permanent integral junction situated between an outer end of said loop and a cleated face portion of said linear timing belt section.

12. The timing belt wrench of claim 9, wherein said timing belt wrench comprises:

an integral ring eye formed at said loop; and a loop ring pivotally fastened onto said integral ring eye and encircled about said linear timing belt section;

wherein said loop ring enables said loop to be adjusted;

wherein said loop ring is freely movable in an axial direction along said linear timing belt section.

* * * * *